United States Patent [19]

Lang

[11] Patent Number: 4,505,138

[45] Date of Patent: Mar. 19, 1985

[54] SAVE-A-PUMP

[76] Inventor: William G. Lang, P.O. 87, West Sayville, N.Y. 11796

[21] Appl. No.: 572,510

[22] Filed: Jan. 20, 1984

[51] Int. Cl.[3] ..... D06F 39/00

[52] U.S. Cl. ..... 68/208; 210/463

[58] Field of Search ..... 68/18 F, 208; 210/460, 210/463, 232, 498; 134/104; 137/544; 415/121 G

[56] References Cited

U.S. PATENT DOCUMENTS

| | | | |
|---|---|---|---|
| 960,901 | 6/1910 | Hall | 210/460 X |
| 2,687,216 | 8/1954 | Shelton | 210/463 |
| 2,779,478 | 1/1957 | Wahlin | 210/232 |
| 3,236,386 | 2/1966 | Salisbury et al. | 68/18 F X |
| 3,297,160 | 1/1967 | Humbert, Jr. | 210/232 X |
| 3,481,162 | 12/1969 | Ziegler | 68/18 F X |

FOREIGN PATENT DOCUMENTS

| | | | |
|---|---|---|---|
| 1542840 | 9/1968 | France | 68/18 F |
| 887811 | 1/1962 | United Kingdom | 68/18 F |

*Primary Examiner*—Philip R. Coe
*Attorney, Agent, or Firm*—Leonard Belkin

[57] ABSTRACT

A trap for use in a top loading fabric washing machine for preventing articles of clothing from entering the drain pump. The trap is located within the entrance to the hose connection between the tub and the pump. The trap can be viewed and cleared from outside the machine, and comprises a screen made up of cross members of curved cross section widely spaced to minimize accumulation of lint and dirt.

2 Claims, 4 Drawing Figures

FIG. 1
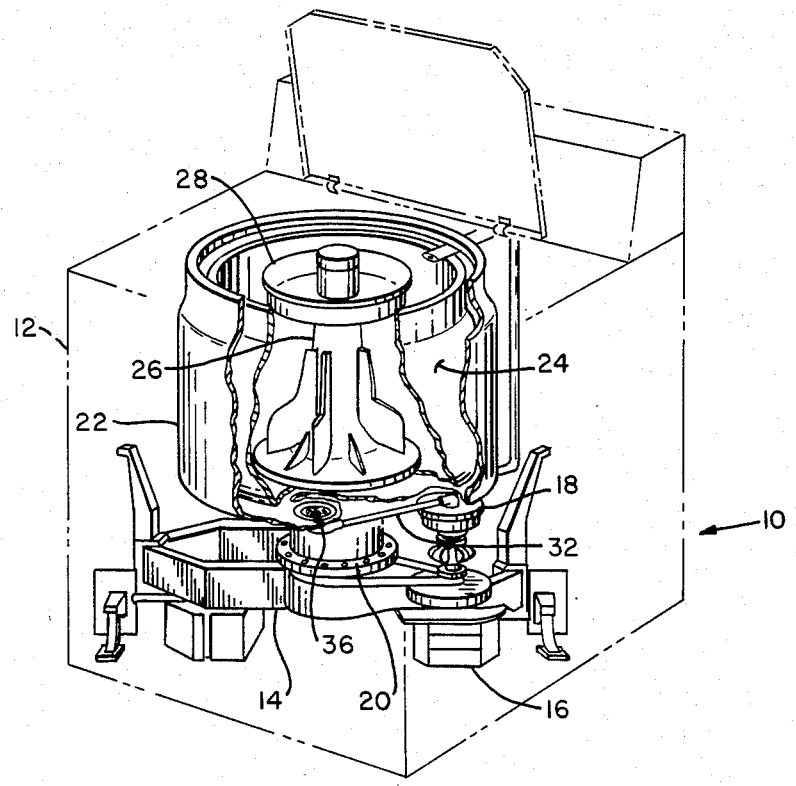
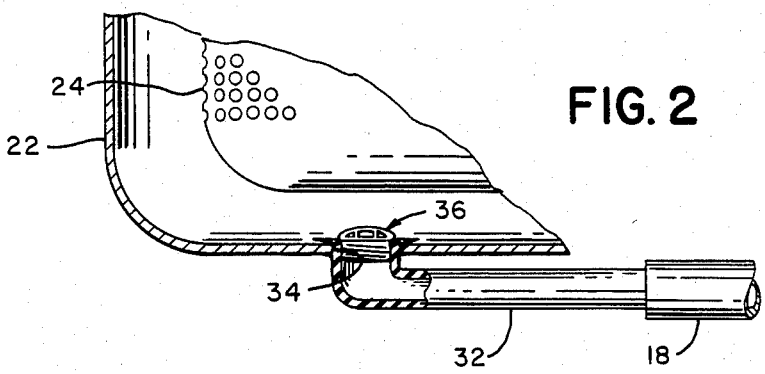
FIG. 2
FIG. 3
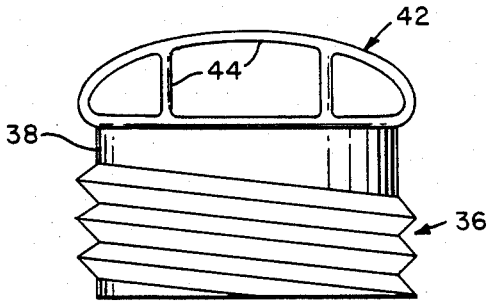
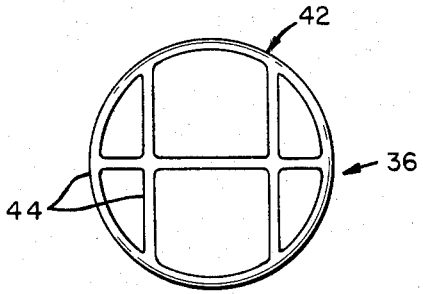
FIG. 4

SAVE-A-PUMP

BACKGROUND OF THE INVENTION

This invention relates to a top loading washing machine and more particularly to a washing machine having provision to prevent small articles of clothing from entering the drain pump.

One of the recurrent problems of existing clothes washing machines is the tendency of small articles of clothing such as a stocking to get by existing labyrinth arrangements and enter the drain pump inlet. Not only does this occurrence prevent continued operation of the machine necessitating disassembly of the drain pump inlet to remove the article but also can result in damage to the pump, the clutch, and motor, for driving the pump, and flooding of the wash room area.

As illustrated in U.S. Pat. Nos. 3,236,386, 3,481,162 and 3,590,741, attempts have been made to overcome this difficulty by the use of a screen mounted in the washtub at the entrance to hose connection to the inlet to the pump. A drawback of such an arrangement is that lint and similar residue gradually collects on the screen rather than pass out with the drain water and will interfere with operation of the pump. Furthermore, attachment of the screen to the tub complicates maintenance and repair procedures. Metal screens also present problems of corrosion.

SUMMARY OF THE PRESENT INVENTION

In the present invention the disadvantages in the use of a screen to block entry of articles of clothing into the suction of the drain pump is accomplished by using a hose mounted trap for the clothing which will not collect lint or dirt to any significant extent. The trap is located in the bottom of the wash tub within the hose connection where it can readily be inspected for the presence and removal of clothing caught in it.

In a preferred embodiment of this invention the trap mounted in the entrance to the drain pump inlet hose consists of a grid having openings which are at least one half inch in any one direction, and grid members having a cross section shaped to reduce turbulence where the water passes through thereby depositing less lint and dirt. The entrance is located in the wash tub at a location where access can be gained for inspection and clothes removal without disassembling any part of the washing machine.

It is thus a principal object of this invention to provide an arrangement in a fabric washing machine for preventing articles of clothing from entering the drain pump.

Other objects and advantages of this invention will hereinafter become obvious from the following description of a preferred embodiment of this invention.

BRIEF DESCRIPTION OF THE FIGURES

FIG. 1 is an isometric view of a fabric washing machine in phantom showing some of its principal components.

FIG. 2 is a partial section of a portion of the wash tub showing a preferred embodiment of this invention.

FIG. 3 shows an elevation view of the trap.

FIG. 4 is a top view of the trap illustrated in FIG. 3.

DESCRIPTION OF THE PREFERRED EMBODIMENT

Referring to FIGS. 1 and 2, top loading washer 10 consists of a housing 12 containing structure 14 for supporting a motor 16, pump 18, transmission 20, wash tub 22, wash basket 24, agitator 26, and a filter 28. This arrangement is a conventional one in which the clothes to be washed are contained within basket 24, water is circulated from the bottom of tub 22 to the top of basket 24, while agitator 26 is activated.

When a cycle, such as the washing cycle, is completed, pump 18 withdraws lint and dirt laden water from the bottom of tub 22, as more particularly shown in FIG. 2, and delivers the water to a drain (not shown). In order to withdraw the water from tub 22, a drain pump inlet hose 32 connects opening 34 in tub 22 to pump 18. Without some provision for preventing it, an article of clothing which passed out of basket 24 into tube 22 could enter hose 32 and lodge inside of pump 18.

In order to prevent this from occurring and at the same time not to collect lint or dirt or restrict significantly the flow of water into pump 18, there is provided within hose 32 at its entrance a trap 36.

Trap 36, as seen in FIGS. 3 and 4, consists of a threaded cylindrical tube 38 with an arcuate screen or grid 42 covering its entrance. Screen 42 is made of a rubber or plastic material with cross members 44 of curved (ie, circular or oval) cross section and spaced at least $\frac{1}{2}''$ in any direction. With this design, turbulence of the water passing through is reduced and the deposit of lint or dirt on members 44 is virtually eliminated.

The location of opening 34 in the bottom of tub 22 is such that if basket 24 is tipped slightly, screen 36 can be viewed from the top of washer 10 when its top lid is open, and any article of clothing trapped on screen 42 can easily be removed. Also, if desired, trap 36 may be unscrewed from hose 32 and be replaced. Further, it is noted that trap 36 is also removed when hose 32 is removed as the former is mounted in the latter, not in tub 22.

It is thus seen there has been provided an improved arrangement for protecting the drain pump and other mechanical equipment within a fabric washing machine. While only a preferred embodiment of the invention has beed described it is understood that many variations thereof are possible without departing from the principles of this invention as defined in the claims which follow.

What is claimed is:

1. In a top loading fabric washing machine having a wash tub, a pump for withdrawing lint and dirt laden water from said tub for discharge, an opening in the bottom of said tub situated where it can be viewed and reached from the top opening into said machine, a drain pump hose connecting said tub opening with the inlet to said pump, a trap mounted through said tub opening into said hose and removeable therewith, said trap comprising a screen consisting of spaced cross members, the spaces between said members in any direction being not less than $\frac{1}{2}$ inch, each of said cross members being curved in cross section so as to minimize turbulence of water flow therethrough, and a threaded body for threaded engagement with said hose, said trap being designed to pass the lint and dirt laden water and minimize the accumulation of such lint and dirt on said cross members.

2. In the washing machine of claim 1, said screen being constructed of non-metallic material.

* * * * *